United States Patent [19]

Schlack

[11] Patent Number: 4,554,480

[45] Date of Patent: Nov. 19, 1985

[54] CATHODE-RAY TUBE HAVING AN ELECTRON GUN ASSEMBLY WITH EMISSIVITY MODIFYING MEANS

[75] Inventor: Richard E. Schlack, Lower Winsor Township, York County, Pa.

[73] Assignee: RCA Corporation, Princeton, N.J.

[21] Appl. No.: 556,184

[22] Filed: Nov. 29, 1983

[51] Int. Cl.[4] ..... H01J 19/14; H01J 29/46

[52] U.S. Cl. ..... 313/446; 313/270; 313/337

[58] Field of Search ..... 313/446, 456, 38, 270, 313/337

[56] References Cited

U.S. PATENT DOCUMENTS

| | | | |
|---|---|---|---|
| 2,914,694 | 11/1959 | Chin | 313/270 |
| 3,145,318 | 8/1964 | Paull | 313/82 |
| 3,265,920 | 8/1966 | Fiore | 313/240 |
| 3,333,138 | 7/1967 | Szegho | 313/270 |
| 3,351,792 | 11/1967 | Kuryla | 313/38 |
| 3,354,340 | 11/1967 | Almer et al. | 313/82 |
| 3,569,768 | 3/1971 | Benda | 313/270 |
| 3,895,249 | 7/1975 | Andre et al. | 313/37 |
| 3,958,146 | 5/1976 | Buescher et al. | 313/346 R |
| 4,009,409 | 2/1977 | Buescher et al. | 313/337 |
| 4,063,128 | 12/1977 | Hughes | 313/409 |
| 4,071,803 | 1/1978 | Takanashi et al. | 313/409 |
| 4,184,100 | 1/1980 | Takanashi et al. | 313/337 |
| 4,370,588 | 1/1983 | Takahashi et al. | 313/270 |

OTHER PUBLICATIONS

U.S. patent application Ser. No. 06/556,185, filed concurrently herewith, by S. T. Opresko, and entitled, "Cathode-Ray Tube having an Electron Gun Assembly with an Improved Cathode Eyelet Structure".

*Primary Examiner*—Palmer C. DeMeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

In a cathode-ray tube an inline electron gun assembly includes a center cathode assembly disposed between two outer cathode assemblies. The center cathode assembly and the outer cathode assemblies each comprise a tubular cathode sleeve having oppositely disposed ends, a filament disposed within the sleeve and spaced therefrom, and a cathode eyelet coaxially surrounding at least a portion of the cathode sleeve. The cathode sleeve is open at one end and closed at the other end by a cap having an electron emissive material thereon. The open end of the cathode sleeve is attached to the interior surface of the eyelet. At least a portion of the interior surface of at least one of the eyelets is modified to change the radiant energy emission characteristics thereof.

4 Claims, 2 Drawing Figures

CATHODE-RAY TUBE HAVING AN ELECTRON GUN ASSEMBLY WITH EMISSIVITY MODIFYING MEANS

BACKGROUND OF THE INVENTION

The invention relates to a cathode-ray tube having an electron gun assembly therein and more particularly to the cathode assemblies of such a gun assembly wherein emissivity modifying means are included in less than all of the cathode assemblies.

A typical cathode-ray tube, e.g., a color television picture tube, includes an electron gun assembly comprising three substantially identical electron guns, each of which generates and focuses an electron beam which impinges on a different color phosphor element disposed on an interior surface of the tube faceplate. In a conventional tube, the phosphor elements are red-, green-, and blue-emitting stripes or dots, which are stimulated to emission by the aforementioned electron gun assembly. The electron gun that provides an electron beam which impinges on the red-emitting phosphor element will be hereinafter referred to as the red gun. The same convention will also apply to the green gun and the blue gun.

In a television receiver, it is desirable that when the receiver is switched on, the picture appears quickly and with the proper colors. This capability is directly related to the rate of increase in electron gun cathode temperature. Some receiver manufacturers require that the initial screen color (with no video signal) be either white or green, rather than red, blue or purple. A white screen indicates equal color balance between the red, green and blue guns. A green color indicates that the cathode of the green gun has reached emission temperature before the cathodes of the red and blue guns.

In the prior art, it was known to preheat the cathode heater to meet the demand of quick turn-on. However, even a quick turn-on system does not always provide a white or green initial screen color. Furthermore, the preheated cathodes use power when the television receiver is out of use. Such a structure is energy inefficient.

U.S. Pat. No. 4,184,100, issued to Takanashi et al. on Jan. 15, 1980, discloses an indirectly-heated cathode device of the quick-heat type. A cathode sleeve in the Takanashi et al. patent is formed from one of a number of high strength alloys, which permits the fabrication of a thin wall cathode sleeve, which is free from deformations and has small heat capacity. The Takanashi et al. patent addresses the quick-heat problem but does not suggest a structure for providing an initial white or green screen color.

U.S. Pat. No. 4,370,588, issued to Takahashi et al. on Jan. 25, 1983, discloses a low power, quick turn-on cathode. In the Takahashi et al. patent, a cathode sleeve is blackened, and a first reflective cylindrical member is fixed on the top end of the cathode sleeve. A second reflective cylinder, having a larger diameter than the cathode sleeve, is attached to the sleeve by support members. The reflective cylinders reflect radiated heat back to the cathode sleeve to maintain the cathode temperature and shorten the turn-on time. Such a structure does not specifically address the problem of having a white or green screen color when the cathode reaches emission temperature.

As disclosed in U.S. Pat. No. 4,071,803, issued to Takanashi et al. on Jan. 31, 1978, it is difficult to control the variation of the cathode electrode-to-grid electrode spacing due to temperature variation. "White balance", i.e., white screen color, is affected by dimensional variations in the cathode-to-grid electrode spacing so that, even with quick turn-on cathodes of substantially identical construction, "white balance"may not be immediately achieved, and the picture does not become normal until the dimension of the electron gun structure becomes thermally stable.

Since an initial white screen color requires that all three electron guns reach emission temperature substantially simultaneously, it is more convenient to provide an initial green screen color than it is to achieve a white screen color.

SUMMARY OF THE INVENTION

In a cathode-ray tube, an electron gun assembly includes a plurality of cathode assemblies, each comprising a cathode sleeve having oppositely disposed ends, a heater filament disposed within the sleeve and spaced therefrom, and a cathode eyelet coaxially surrounding at least a portion of the cathode sleeve. The cathode sleeve is open at one end and closed at the other end by a cap having an electron emissive material thereon. The open end of the cathode sleeve is attached to the interior surface of the eyelet. At least a portion of the interior surface of at least one of the eyelets includes emissivity modifying means to change the radiant energy emission characteristics thereof to be different than the radiant energy emission characteristics of a similar portion of at least one other of said eyelets.

DETAILED DESCRIPTION OF THE PREFERRED EMBODIMENTS

Figure 1:
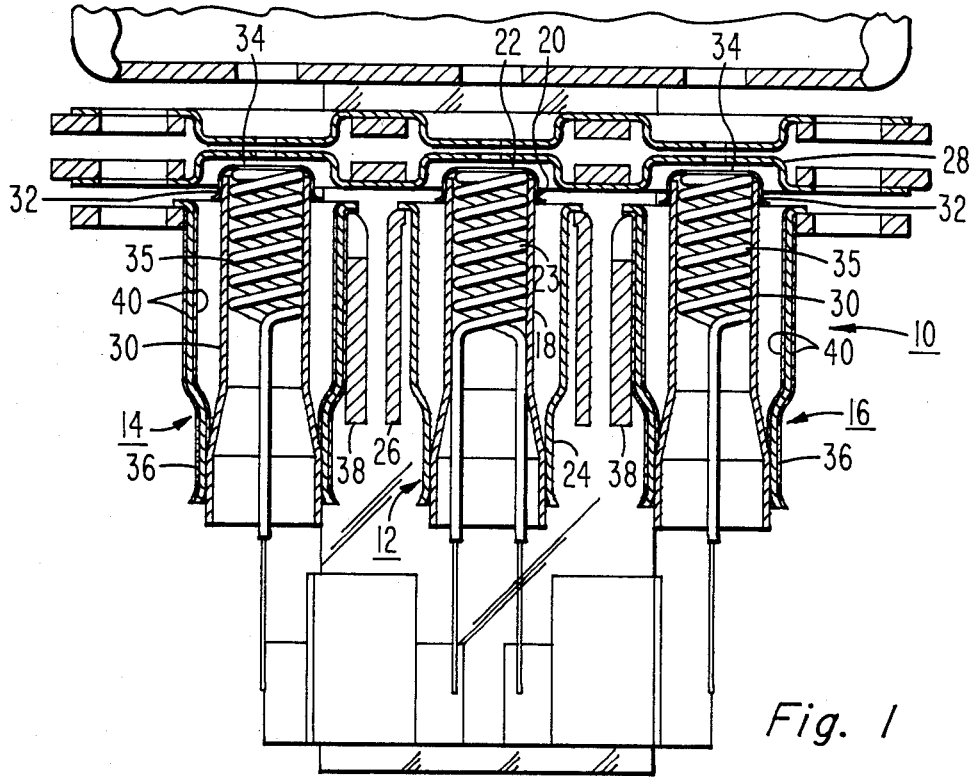
FIG. 1 is a sectional view of a portion of an inline electron gun assembly embodying the present invention.
Figure 2:
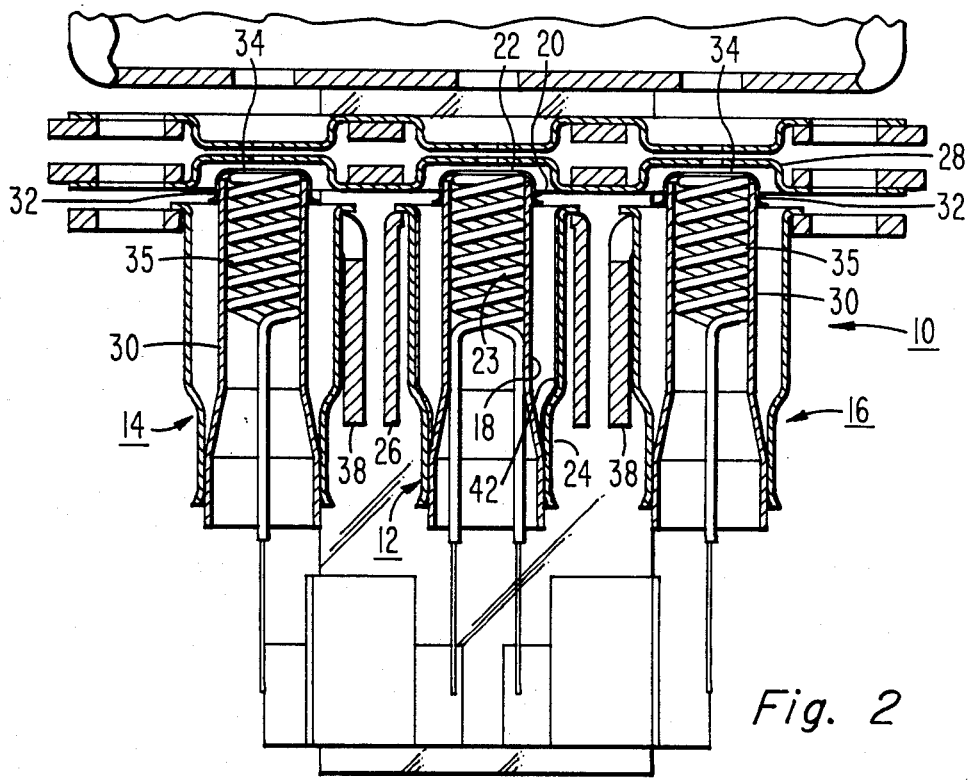
FIG. 2 is a sectional view of a portion of an inline electron gun assembly showing a second embodiment of the present invention.

In FIG. 1, there is shown a portion of an electron gun assembly 10 of a type used in color television picture tubes. The electron gun assembly 10 comprises a center cathode assembly 12 (the green gun), a first outer cathode assembly 14 (the red gun), and a second outer cathode assembly 16 (the blue gun). The center cathode assembly 12 comprises a cathode sleeve 18 closed at the forward end by a cap 20 having an end coating 22 of an electron emissive material thereon. A heater filament 23 is mounted within the cathode sleeve 18 and spaced therefrom. The electron emissive coating 22 is supported at a predetermined spacing from a first grid 28 (also referred to as the control grid) by a center cathode eyelet 24, which coaxially surrounds at least a portion of the cathode sleeve 18. The eyelet 24 has an interior surface and an exterior surface with the oppositely disposed open end of the cathode sleeve 18 being attached, for example, by welding, to the interior surface of the eyelet 24. A center cathode support 26 is attached, also by welding, to the exterior surface of the forward end of the center eyelet 24.

Similarly, the first and second outer cathode assemblies 14 and 16 each comprise a cathode sleeve 30 closed at the forward end by a cap 32, having an end coating 34 of an electron emissive material thereon. A filament 35 is mounted within each cathode sleeve 30 and spaced therefrom. The electron emissive coatings 34 are each maintained at a predetermined spacing from the first grid 28 by a cathode eyelet 36, which coaxially surrounds at least a portion of the cathode sleeve 30. The eyelet 36 has an interior surface and an exterior surface with the oppositely disposed open end of the cathode sleeve 30 being attached, for example, by welding, to the interior surface of the eyelet 36. An outer cathode support 38 is attached, also by welding, to the exterior surface of the forward end of the outer eyelet 36.

In the present electron gun assembly 10, all three cathode eyelets 24 and 36 are made of the same material, usually an alloy of about 50.5% nickel and about 48% iron, commonly known as 52 Alloy. A more complete description of the properties of 52 Alloy may be found in the American Society for Testing and Materials standard F30. The center cathode support 26 and the outer cathode supports 38 are made of type 305 stainless steel and 52 Alloy, respectively, and are described in U.S. Pat. No. 4,468,588, issued to Schlack et al. on Aug. 24, 1984 herein for the purpose of disclosure.

In order to facilitate the rapid warm-up and emission from the green gun, i.e., the cathode assembly 12, either the emissivity of the center cathode assembly can be decreased, or the emissivity of the red and blue guns, i.e., the outer cathode assemblies 14 and 16, respectively, can be increased. In the preferred embodiment, the emissivity of the outer cathode assemblies 14 and 16 can be increased by oxidizing the inner and outer surfaces of the eyelet 36. The eyelet is formed of 52 Alloy, which can be oxidized by firing the eyelets at about 800° C. for about 10 minutes in a wet nitrogen ($N_2$) atmosphere. An oxide layer 40 is formed on at least the interior surface and preferably on both the interior and exterior surfaces of the eyelet 36. The total hemispherical emissivity of the eyelet 36, prior to oxidizing, is of the order of about 0.35. After oxidizing, the oxidized surface of the eyelet 36 has an emissivity of about 0.85. The increase in emissivity of the outer eyelets 36 increases the heat transfer away from the outer (red and green guns) cathode assemblies 14 and 16 without changing the heat transfer characteristics of the green gun, i.e., the center cathode assembly 12. Thus, by modifying the emissivity of the two outer cathode assemblies while leaving the emissivity of the center cathode assembly unchanged, the temperature rise of the outer cathode assemblies 14 and 16 is decreased relative to the temperature rise of the center cathode assembly 12. This change in eyelet structure will increase the probability that the green gun, i.e., center cathode assembly, will reach emission temperature before the red and blue guns.

A test was conducted comparing the emission characteristics of six control cathode-ray color picture tubes having 52 Alloy eyelets, which were unmodified, and six test tubes in which the outer cathode eyelets 36 were oxidized, as described herein, to increase the heat transfer away from the red and blue guns, i.e., outer cathode assemblies 14 and 16. Only one of the six control tubes showed green emission initially, whereas four of the six test tubes initially showed green emission. While it was desirable that all of the test tubes showed initial green emission, the fact that two did not can be explained by uncontrolled changes in other parameters, such as heater filament reistance, heater filament insertion in the cathode sleeve, unequal thermal changes, or possibly even by electron emissive material thickness variations.

An alternative structure of the preferred embodiment can be obtained by using type 304 stainless steel as the material for the center eyelet 24 and also for the outer eyelets 36. If stainless steel is used, the outer eyelets 36 are oxidized by firing at a temperature of about 1000° C. for about 10 minutes in a wet hydrogen atmosphere. The total hemispherical emissivity of the stainless steel eyelets before oxidizing is about 0.29, whereas the emissivity after oxidizing increases to about 0.85.

By plating the interior surface of the center eyelet 24 with a thin coating 42 of silver having an emissitivy of about 0.10 and by leaving the outer cathode eyelets 36 untreated, the heat radiated by the center cathode sleeve 18 will be reflected back to the cathode sleeve to permit the center cathode assembly 12 (green gun) to reach emission temperature before the outer cathode assemblies 14 and 16. It is also within the scope of the present invention to simultaneously lower the emissivity of the center cathode assembly 12, for example, by silver plating the center eyelet 24, and increase the emissivity of the outer cathode assemblies 14 and 16 by, for example, oxidizing the outer eyelets 36.

What is claimed is:

1. In a cathode-ray tube having an electron gun assembly including a plurality of cathode assemblies each comprising a cathode sleeve having oppositely disposed ends, said cathode sleeve being open at one end and closed at the other end by a cap having an electron emissive material thereon, a heater filament disposed within said sleeve and spaced therefrom, and a cathode eyelet coaxially surrounding at least a portion of said cathode sleeve, said eyelet having an interior surface and an exterior surface, said open end of said cathode sleeve being attached to said interior surface of said eyelet, the improvement wherein at least a portion of said interior surface of at least one of said eyelets includes emissivity modifying means to change the radiant energy emission characteristic of said portion of said interior surface to be different from the radiant energy emission characteristic of a similar portion of at least one other of said eyelets wherein said emissivity modifying means comprises an oxide coating formed on at least the interior surface of said cathode eyelets to increase the emissivity thereof.

2. In a cathode-ray tube having an electron gun assembly including a plurality of cathode assemblies each comprising a cathode sleeve having oppositely disposed ends, said cathode sleeve being open at one end and closed at the other end by a cap having an electron emissive material thereon, a heater filament disposed within said sleeve and spaced therefrom, and a cathode eyelet coaxially surrounding at least a portion of said cathode sleeve, said eyelet having an interior surface and an exterior surface, said open end of said cathode sleeve being attached to said interior surface of said eyelet, the improvement wherein at least a portion of said interior surface of at least one of said eyelets includes emissivity modifying means to change the radiant energy emission characteristic of said portion of said interior surface to be different from the radiant energy emission characteristic of a similar portion of at least one other of said eyelets wherein said emissivity modifying means comprises a reflective coating formed on the interior surface of said cathode eyelet to decrease the emissivity thereof, said reflective coating comprises silver.

3. In a cathode-ray tube having an inline electron gun assembly including a center cathode assembly disposed between two outer cathode assemblies, said center cathode assembly and said outer cathode assemblies each comprising a tubular metal cathode sleeve having oppositely disposed ends, said cathode sleeve being open at one end and closed at the other end by a cap having an electron emissive material thereon, a heater filament disposed within said sleeve and spaced therefrom, and a metal cathode eyelet coaxially surrounding at least a portion of said cathode sleeve, said eyelet having an interior surface and an exterior surface, said open end of said cathode sleeve being attached to said interior surface of said eyelet, the improvement wherein at least a portion of at least said interior surface of said eyelets of said outer cathode assemblies including an oxide coating thereon to increase the emissivity of said eyelets of said outer cathode assemblies.

4. In a cathode-ray tube having an inline electron gun assembly including a center cathode assembly disposed between two outer cathode assemblies, said center cathode assembly and said outer cathode assemblies each comprising a tubular metal cathode sleeve having oppositely disposed ends, said cathode sleeve being open at one end and closed at the other end by a cap having an electron emissive material thereon, a heater filament disposed within said sleeve and spaced thereform, and a metal cathode eyelet coaxially surrounding at least a portion of said cathode sleeve, said eyelet having an interior surface and an exterior surface, said open end of said cathode sleeve being attached to said interior surface of said eyelet, the improvement wherein at least a portion of said interior surface of the eyelet of said center cathode assembly including a reflective coating of silver thereon to decrease the emissivity of said eyelet of said center cathode assembly.

* * * * *